US009624673B2

(12) United States Patent
Conner

(10) Patent No.: US 9,624,673 B2
(45) Date of Patent: Apr. 18, 2017

(54) ENHANCED GUTTER HANGER

(71) Applicant: Darren Dean Conner, St. John, IN (US)

(72) Inventor: Darren Dean Conner, St. John, IN (US)

( * ) Notice: Subject to any disclaimer, the term of this patent is extended or adjusted under 35 U.S.C. 154(b) by 0 days.

(21) Appl. No.: 14/583,474

(22) Filed: Dec. 26, 2014

(65) Prior Publication Data

US 2015/0184393 A1 Jul. 2, 2015

Related U.S. Application Data

(60) Provisional application No. 61/921,390, filed on Dec. 27, 2013.

(51) Int. Cl.
*E04D 13/072* (2006.01)

(52) U.S. Cl.
CPC ..... *E04D 13/0725* (2013.01)

(58) Field of Classification Search
CPC combination set(s) only.
See application file for complete search history.

(56) References Cited

U.S. PATENT DOCUMENTS 3,295,803 A * 1/1967 Blayden ..... 248/48.2
3,752,428 A * 8/1973 Trostle et al. ..... 248/48.2
4,294,422 A * 10/1981 Odekirk ..... 248/48.2
4,776,544 A 10/1988 Williams
5,004,191 A * 4/1991 Corry ..... 248/48.2
5,271,192 A * 12/1993 Nothum et al. ..... 52/12
5,388,377 A * 2/1995 Faulkner ..... 52/11
5,845,435 A * 12/1998 Knudson ..... 52/11
5,862,631 A * 1/1999 Attaway et al. ..... 52/11
6,209,826 B1 * 4/2001 Pratt, Jr. ..... 248/48.2
6,254,039 B1 * 7/2001 Zimmerman ..... 248/48.2
6,453,622 B1 * 9/2002 Walters ..... 52/12
6,543,729 B1 * 4/2003 Ylonen ..... 248/48.1
6,631,587 B2 * 10/2003 Lynch ..... 52/11
6,658,796 B1 * 12/2003 Higgins ..... 52/11
6,726,155 B1 * 4/2004 Zimmerman ..... 248/48.1
6,993,870 B2 * 2/2006 McDonald et al. ..... 52/11
7,117,643 B2 * 10/2006 Brown ..... 52/12
7,494,095 B2 * 2/2009 Walker et al. ..... 248/48.2
7,523,894 B1 * 4/2009 Eddy ..... 248/48.2
7,730,672 B2 * 6/2010 Knudson et al. ..... 52/12
7,861,980 B1 * 1/2011 Verbrugge et al. ..... 248/48.2
8,117,785 B2 * 2/2012 Teichner et al. ..... 52/11
8,225,556 B2 * 7/2012 Brown ..... 52/12
8,347,557 B2 * 1/2013 Minor et al. ..... 52/11
2004/0000098 A1 * 1/2004 Knudson ..... 52/12
(Continued)

*Primary Examiner* — Monica Millner
(74) *Attorney, Agent, or Firm* — Wood, Phillips, Katz, Clark & Mortimer

(57) ABSTRACT

A gutter hanger for hanging a rain gutter on the fascia board of a structure or building. The gutter hanger includes an elongated horizontal top member connected to a downwardly extending back member, the top and back member connected by a web of material. A bore for a fascia screw extends from the top member, through the web, and exit the back member. The gutter hanger also includes an upwardly extending protrusion to engage the lip of the gutter. The top member also includes a threaded bore hole to accept a screw, so that the top member may be attached to the top front of the gutter with a threaded fastener.

18 Claims, 3 Drawing Sheets

(56) References Cited

U.S. PATENT DOCUMENTS

| | | | | |
|---|---|---|---|---|
| 2004/0211124 | A1* | 10/2004 | Hardin | 52/11 |
| 2005/0082436 | A1* | 4/2005 | Snell | 248/48.2 |
| 2005/0172565 | A1* | 8/2005 | Riley et al. | 52/12 |
| 2010/0251626 | A1* | 10/2010 | Roque Alonso | 52/12 |
| 2014/0196400 | A1* | 7/2014 | Bell | 52/705 |

* cited by examiner

ENHANCED GUTTER HANGER

RELATED APPLICATIONS

This application claims priority to U.S. provisional application 61/921,390 filed on Dec. 27, 2013. The contents of that application are herein incorporated by reference in its entirety.

FIELD OF THE INVENTION

The invention is in the field of hangers for securing rain gutters to structures and buildings.

BACKGROUND OF THE INVENTION

The invention relates to gutters that are typically found on the sides of structures to catch and channel away rainwater that flows off of the structure's roof. The gutters generally have a front side, bottom, and back side. The gutters are generally mounted onto the side of the structure using a plurality of gutter hangers spaced apart from each other along the length of the gutter. The gutter hangers are typically attached to the structure and the gutter with building fasteners, such as screws, nails, and rivets.

Gutter hangers of the prior art are numerous. Some support the gutter from the outside, such as U.S. Pat. No. 4,776,544 to Williams. Others support the gutter internally from the top of the gutter such as U.S. patent application Ser. No. 13/739,745 to Bell. Some gutter hangers of the prior art require the installer to lift the shingles near the fascia board to install the gutter hanger over the back edge of the gutter. This common practice can break the seal at the bottom of the roofing shingles, allowing wind and water to get under the shingles or even tear the shingles, causing damage to the roof and structure. The gutter hanger of the present invention installs in the interior of the gutter, and does not require the installer to lift or otherwise disturb the shingles on the roof of the structure.

SUMMARY OF THE INVENTION

The gutter hanger of the present invention is a significant improvement over the gutter hangers of the prior art. The gutter hanger is generally an L shaped bracket that includes a top portion or leg that interiorly spans the top of the gutter, and a downward extending leg that extends down the back interior side of the gutter. The downward extending leg or support holds the back of the gutter against the fascia board for substantially the entire depth of the gutter, reducing the opportunity for wind to get between the rear of the gutter and the fascia board. This reduces gutter movement from the wind and can increase the life expectancy of the gutter.

The gutter hanger of the present invention also includes an angled predrilled hole. The hole accepts a screw for attaching the gutter hanger and gutter to the fascia board of the structure. Because the gutter hanger has a downward extending leg or support that may be as a gauge or guide to fix the distance from the bottom of the gutter, the hole for the screw that attaches the gutter to the fascia board is easily set at the same distance from the bottom of the gutter for each gutter hanger used. Thus the gutter hanger is used as a guide to insure that all of the hangers are installed consistently at the same level within the gutter, resulting in an improved aesthetic, as the gutters can be kept straighter. Setting a uniform distance from the bottom of the gutter also aids in keeping the front of the gutter uniform in appearance.

It is preferred that the gutter hanger fascia screw is angles so that the hole made in the gutter is not too near the bottom of the gutter that there is a risk of water leaking through the hole and penetrating the fascia board. Typically, it is preferred that the fascia screw hole be no lower than half the distance from the gutter back top edge to the bottom of the gutter. Further, the angle of the fascia screw hole preferably allows the drill used to fasten the screw to vertically clear the front edge of the gutter during installation of the fascia screw. With these concerns in mind, the fascia screw hole or bore may be placed at a wide range of angles, ranging from approximately 10 degrees to 45 degrees from horizontal.

The fascia screw hole or bore may also include a larger counter sink bore having a surface that is circumfrential and perpendicular to the axis of the fascia screw hole. This surface provides a surface for the head of the fascia screw to bear upon, lessening the chance of overdriving the screw and possibly damaging the gutter hanger as the head of the fascia screw is accidentally driven into the fascia screw hole, creating a wedge force to split the gutter hanger.

The depth of the countersink is preferably anywhere from 0.25 inches to 2 inches. A shallow depth countersink allows the head of the fascia screw to lie below the top surface of the top leg of the gutter hanger. This positioning allows the installation of gutter debris guards above the gutter hanger without interference from the fascia screw head. A deeper counter sink will work as well, with the added benefit of allowing snag free reinstallation of the fascia screw.

If the countersink is sufficiently deep, a fascia screw can be preinstalled at the factory, saving the installer the time of having to locate a screw, place the screw in the hole, align the gutter, and drive the screw. With the preinstalled fascia screw, the counter sink should be as deep as the desired length the screw should go into the board. This is typically 0.5 to 1.75 inches. With such a countersink, the screw can be preinstalled at the factory so that the threads of the screw engage sufficiently to hold the screw in the hole, usually 1 to two turns, and so that the head of the screw is below the top surface of the top leg. Thus the screw does not protrude above the top surface of the top leg, allowing the gutter hangers to be easily and compactly packaged for shipment. Also, there is a reduced opportunity for the screw to get snagged on something at the installation site, thereby easing installation.

The downward extending back leg of the gutter hanger, as well as the presence of a web of material where the top portion and the downward extending leg come together, provided added support so that the gutter does not droop or otherwise sag when full of ice and snow. The nose or front of the top portion also includes a predrilled hole that may be threaded. This allows for the fixed attachment of the front of the gutter to the gutter hanger by means of a threaded fastener such as a screw. This provides a more secure attachment and support for the gutter, as previous designs such as that shown in the Bell application, to positively attach the front of the gutter to the hanger. Instead, the gutter lip or flange rests on the top of the gutter hanger. If the gutter fills with ice and snow, the added weight can cause the lip of the gutter to bend, creating an unattractive non-uniform appearance. Even worse, the gutter lip could bend enough to fail.

The gutter hanger of the present invention allows the front of the gutter to be attached so that the weight of the contents does not bear on the lip of the gutter, but instead bears on the screw or other fastener. The fastener can be removed and reinstalled multiple times, allowing for other things to the attached to the gutter hanger by way of a threaded fastener.

For instance, holiday lights or hooks for hanging holiday lights or planters, or brackets for other things used around a home such as security cameras may be reliably attached to the gutter hanger. As the gutter hanger is strong with the additional support provided by the back leg, the design of the present invention.

For added strength, the gutter hanger of the present invention can include a ridge or flange of material around its perimeter to increase the strength of the hanger but reducing material costs and bulk. The gutter hanger may be as thick or thin as the application requires, so long as the nose the web portions allow for sufficient material to allow for the screw bores or holes.

DETAILED DESCRIPTION OF THE PREFERRED EMBODIMENT

Figure 1:
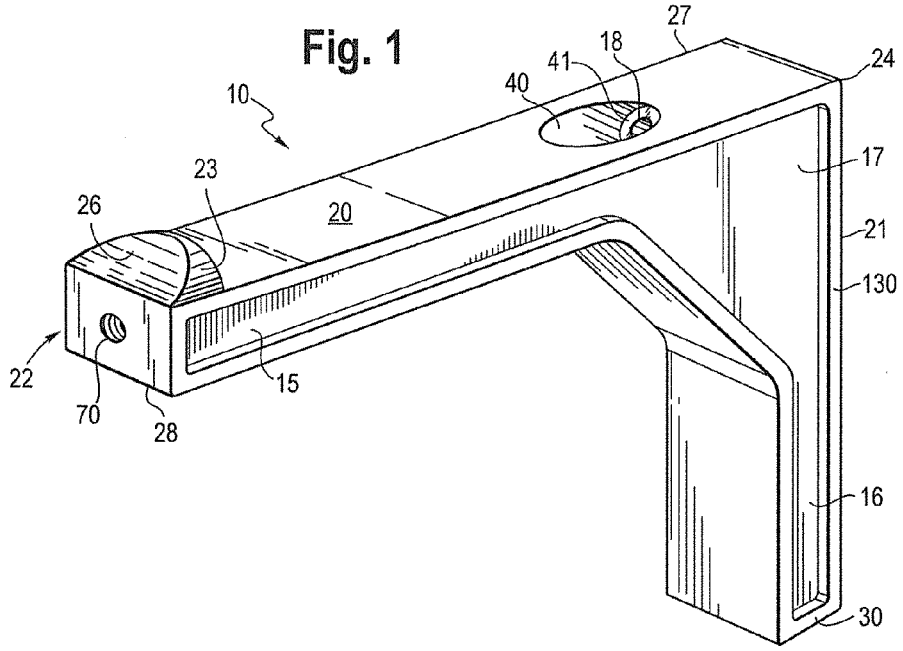
FIG. 1 is a top perspective view of the gutter hanger.
Figure 2:
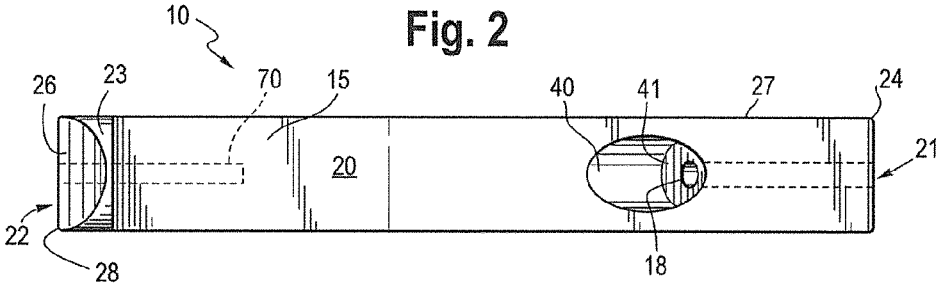
FIG. 2 is a top elevation view of the gutter hanger.
Figure 3:
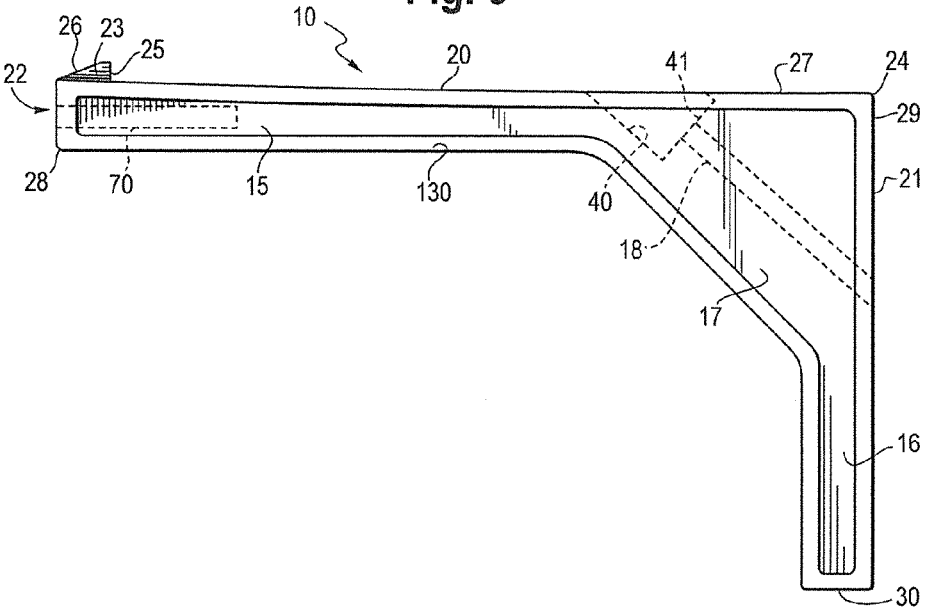
FIG. 3 is a side elevation view of the gutter hanger.
Figure 4:
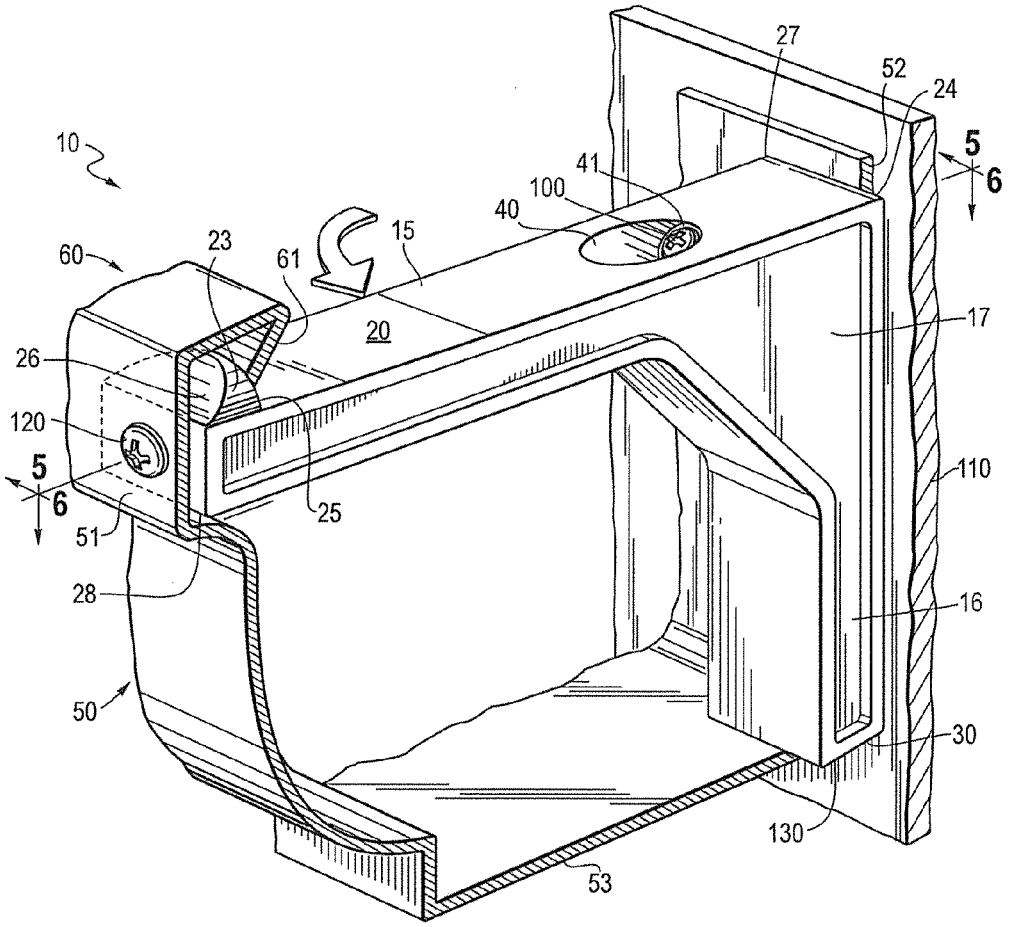
FIG. 4 is a top perspective partial cut away view of the gutter hanger installed in a gutter and attached to a fascia board of a structure.
Figure 5:
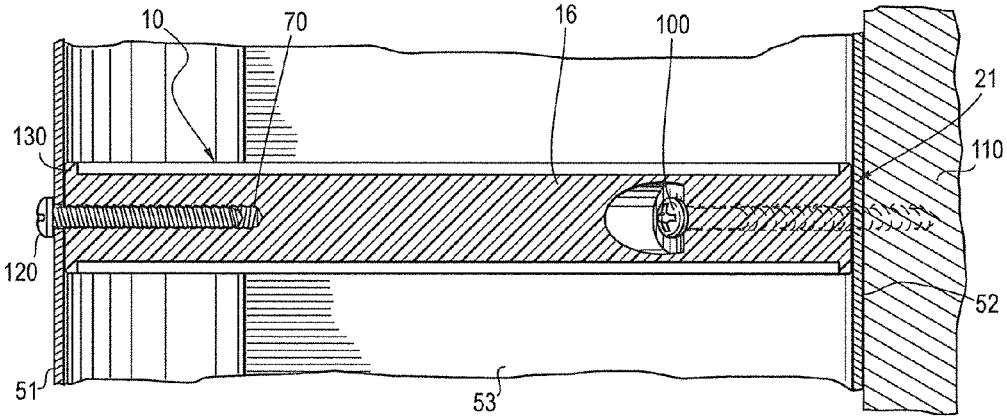
FIG. 5 is a top cross sectional view of the gutter hanger and gutter of FIG. 4.
Figure 6:
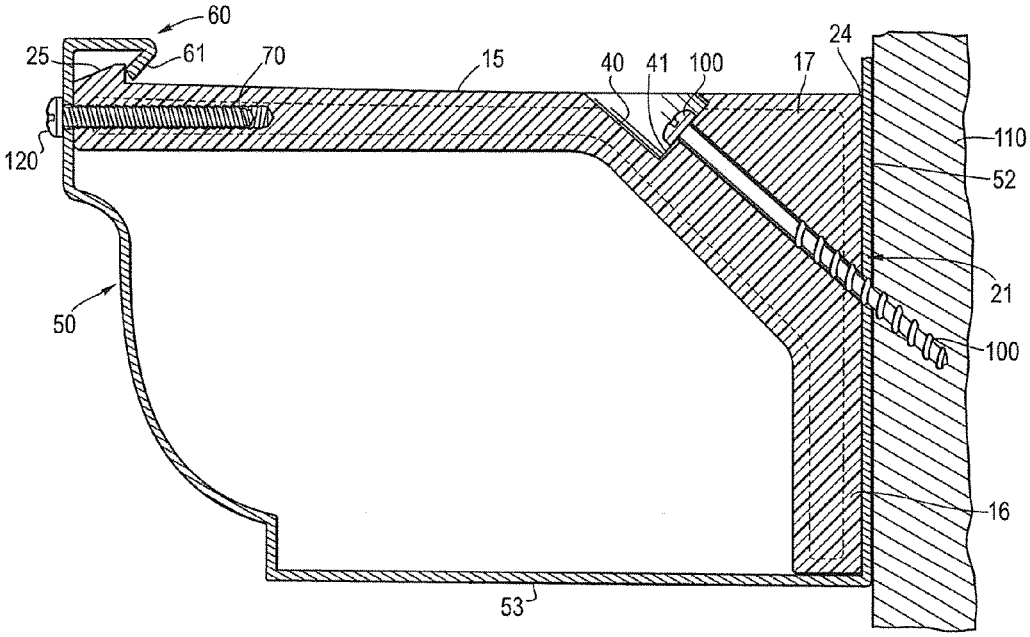
FIG. 6 is a side cross sectional view of the gutter hanger and gutter of FIG. 4.

The foregoing disclosure of specific embodiments is intended to be illustrative of the broad concepts comprehended by the invention. With reference to the figures, the gutter hanger 10 includes an elongated top member or leg 15 and an elongated back member or leg 16. The top leg 15 and back leg 16 are positioned at approximately right angles so that the top leg 15 is horizontally positioned and the back leg 16 is vertically positioned in the gutter 50. The top leg 15 includes a top surface 20 and the back leg 16 includes a back surface 21. The gutter hanger 10 may be constructed of many materials, such as wood, metal, or plastic. It is preferred that the top leg 15, back leg 16, and web 17 are integrally formed. In the most preferred embodiment, the gutter hanger 10 is made of ABS plastic.

The top leg 15 includes a proximal end 27 and a distal end 28. The distal end 28 forms the nose 22. The nose 22 includes an upward extending protrusion 23 having a highest point of elevation for engaging the lip 60 of the gutter 50. The back leg 16 includes a proximal end 29 and a distal end 30. The top leg 15 is of sufficient length to span from the front 51 of the gutter 50 to the back 52 of the gutter 50. The back leg 16 is of sufficient length to extend down to the bottom 53 of the gutter 50 when the top leg 15 is positioned horizontally in the gutter 50.

While the gutter hanger may have flat sides, in the most preferred embodiment, each side of the gutter hanger 10 includes a ridge 130 about the perimeter of the gutter hanger. The sides of the gutter hanger are generally perpendicular to both the top surface 20 and the back surface 25. Each ridge 130 may be continuous, or discontinuous, and extends from the side of the gutter hanger in planes that is generally perpendicular to the side of the gutter hanger.

The top leg proximal end 27 and the back leg proximal end 29 are joined or merge at a vertex 24. A web of material 17 extends between the top leg proximal end 27 and back leg proximal end 29. The web of material 17 may also be considered part of either or both of the top leg 15 and back leg 16, and serves as a convenient way to describe the portion of the gutter hanger that lies between the top leg 15, back leg 17, and vertex 24. The web 17 may take on various shapes and sizes.

The web of material 17 includes a fascia screw bore or hole 18 for acceptance of a fascia screw 100. The fascia screw bore extends from the top surface 20 of the top leg 15 to the back surface 21 of the back leg 16. The fascia screw bore 18 may be threaded in some embodiments, but it is preferred to not be threaded. The fascia screw bore 18 is preferably arranged at a 45 degree angle from horizontal and exits the back surface 21 of the back leg 16 approximately midway between the vertex 24 and the back leg distal end 30. The fascia screw bore 18 may exit the back surface 21 of the back leg 16 at any point, but it is preferable that the exit be somewhere between the vertex 24 and ⅔ of the distance between the vertex 24 and the back leg distal end 30.

The fascia screw bore 18 enters the top surface 20 of the top leg 15 preferably at a counter sink 40. The counter sink 40 is preferably a cylindrical bore coaxially aligned with the fascia screw bore 18. However, the countersink 40 may be of any shape and alignment. The countersink 40 preferably defines an annular surface 41 about the fascia screw bore hole 18, the annular surface being generally perpendicular to the axis of the fascia screw bore hole 18. The counter sink may have any depth, but preferably is between 0.25 to 2 inches depth at a maximum measurement from the top surface 20 of the top leg 15 to the annular surface 41.

The nose 22 of the top leg 15 includes protrusion 23 for engaging the lip 60 of the gutter 50. The protrusion 23 extends upwardly from the top surface 20 of the top member or leg 15. The lip 60 generally includes a downwardly extending tab 61 that is flexible, as it has a living hinge connection to flange on the front 51 of the gutter 10. The flexibility allows protrusion 23 to move and snap under the tab 61 upon installation of the gutter hanger 10, with vertical surface 25 of the protrusion 23 engaging the tab 61. The vertical surface 25 faces toward the proximal end 27 of the top member 15. The protrusion may include ramp 26 extending from the vertical surface 25 to the proximal end 28 of the top leg 15. The ramp 26 is preferably arcuate in shape from side to side with the highest point being approximately equidistant from each side of the top leg 15. The arcuate shape aids in allowing the gutter hanger 10 to be rotated into position and deflect the lip 61 of the gutter 50 upon installation. The arcuate shape of the ramp 26 also creates an arcuate portion of the perimeter of the vertical surface 25.

The proximal end 28 of the top leg 15 includes a front screw bore 70. The front screw bore 70 is preferably threaded to accept a front screw 120. However, the front screw bore 70 need not be threaded in all embodiments of the present invention. The front screw bore 70 is generally oriented horizontally.

To install the gutter hanger 10 of the present invention, the gutter hanger is inserted into the well of the gutter 50 at an angle so that the top leg 15 can fit between the back 52 of the gutter and the lip 60 of the gutter. The distal end 30 of the back leg 16 is placed upon the bottom 53 of the gutter 50 and the gutter hanger 10 is rotated so that the back surface 21 contacts the back 52 of the gutter 20, while at the same time the nose 22 of the top leg 15 of the gutter hanger 10 slides under the lip 60 of the gutter 50. The fascia board screw 100 is then screwed into the fascia screw bore 18 and driven through the gutter back 52 and into the fascia board 110, capturing the back 52 of the gutter 50 between the back surface 21 if the gutter hanger and the fascia board 110.

Upon installation, the front screw 120 penetrates the front 51 of the gutter 50 opposite the front screw bore 70 and is screwed in, capturing and securing the front 51 of the gutter 50 to the nose 22 of the gutter hanger 10.

The invention claimed is:

1. A gutter hanger for hanging a gutter on a structure, the gutter hanger including a top member and a back member joined at a vertex, each member extending away from the vertex at approximately a 90 degree angle to respective distal ends, the top member and back member joined by a web of material extending between the top and back member, and a first bore passing through the top member, web, and back member, and a protrusion located on a top surface of the top member, the protrusion located at the distal end of the top member and being the highest point of elevation of the gutter hanger, wherein the protrusion includes a vertical surface extending from the top surface of the top member and a ramp extending from the protrusion's highest point of elevation to the distal end of the top member.

2. The gutter hanger of claim 1, further including a second bore located in the top member, the second bore extending from the distal end of the top member towards the back member.

3. The gutter hanger of claim 2, wherein the second bore is threaded.

4. The gutter hanger of claim 1, further including a countersink about the first bore, the countersink extending from the top surface of the top member.

5. The gutter hanger of claim 1, wherein the countersink is coaxially aligned with the first bore.

6. A gutter hanger having an elongated top member having a generally horizontal top surface, an elongated back member having a generally vertical back surface, the back member located below the top surface of the top member, the top member and back member being joined to one another by a web of material extending between the top and back member, a first bore extending from the top surface of the top member to the back surface of the back member, the top member further including a protrusion extending upward from the top surface of the top member, the protrusion located at a position distal from the web of material, wherein the protrusion includes a generally vertical surface located above the top surface of the top member, and a ramp extending from the vertical surface to the distal end of the top member.

7. The gutter hanger of claim 6, wherein the top member includes a distal end, the distal end including a generally horizontal second bore.

8. The gutter hanger of claim 7, wherein the second bore is threaded.

9. The gutter hanger of claim 6, wherein the protrusion includes a vertical surface extending from and above the top surface of the top member, the vertical surface facing away from the distal end of the top member.

10. The gutter hanger of claim 1, wherein the generally vertical surface includes an arcuate perimeter portion.

11. The gutter hanger of claim 10, wherein the first bore is surrounded by a countersink.

12. The gutter hanger of claim 11, wherein the first bore and countersink are coaxially aligned, and further including an annular surface surrounding the first bore at the countersink.

13. The gutter hanger of claim 11, further including at least one ridge of material located on a perimeter of a side of the gutter hanger.

14. A gutter hanger for hanging a gutter on a structure, the gutter hanger including a top member and a back member joined at a vertex, each member extending away from the vertex at approximately a 90 degree angle to respective distal ends, the top member and back member joined by a web of material extending between the top member and back member, and a first bore passing through the top member, web, and back member, and a protrusion located on a top surface of the top member, the protrusion located at the distal end of the top member and being the highest point of elevation of the gutter hanger, wherein the protrusion includes a vertical surface extending from the top surface of the top member, and a ramp located between the distal end of the top member and the vertical surface.

15. The gutter hanger of claim 14, further including a second bore located in the top member, the second bore extending from the distal end of the top member towards the back member.

16. The gutter hanger of claim 15, wherein the second bore is threaded.

17. The gutter hanger of claim 14, further including a countersink about the first bore, the countersink extending from the fop surface of the top member.

18. The gutter hanger of claim 14, wherein the countersink is coaxially aligned with the first bore.

* * * * *